US007261608B2

(12) United States Patent
Haddacks

(10) Patent No.: US 7,261,608 B2
(45) Date of Patent: Aug. 28, 2007

(54) VEST WITH AIR BAG

(76) Inventor: William N. Haddacks, 226 Brunswick Avenue, Toronto, Ontario (CA) M5S 2M5

( * ) Notice: Subject to any disclaimer, the term of this patent is extended or adjusted under 35 U.S.C. 154(b) by 0 days.

(21) Appl. No.: 10/859,184

(22) Filed: Jun. 3, 2004

(65) Prior Publication Data

US 2004/0244100 A1 Dec. 9, 2004

Related U.S. Application Data

(60) Provisional application No. 60/475,910, filed on Jun. 5, 2003.

(51) Int. Cl.

| | |
|---|---|
| ***A41D 13/00*** | (2006.01) |
| ***A41D 13/018*** | (2006.01) |
| ***A62B 37/00*** | (2006.01) |
| ***A63B 29/02*** | (2006.01) |
| ***B63C 9/32*** | (2006.01) |

(52) U.S. Cl. ..... 441/80; 2/455; 2/463; 2/464

(58) Field of Classification Search ..... 441/88, 441/102–119, 80, 82; 2/DIG. 3, 2.5, 102, 2/463–467, 455

See application file for complete search history.

(56) References Cited

U.S. PATENT DOCUMENTS

| | | | | |
|---|---|---|---|---|
| 1,798,430 A | | 12/1931 | Markus | |
| 2,607,934 A | * | 8/1952 | Bailhe | 441/107 |
| 2,782,430 A | | 2/1957 | Radnofsky | |
| 4,365,628 A | | 12/1982 | Hodel | 128/205.12 |
| 4,437,790 A | | 3/1984 | Trop | 405/186 |
| 4,569,874 A | * | 2/1986 | Kuznetz | 428/109 |
| 4,635,754 A | | 1/1987 | Aschauer et al. | 182/3 |
| 4,943,252 A | | 7/1990 | Manix | 441/87 |
| 5,079,778 A | * | 1/1992 | Sloot | 2/69 |
| 6,220,909 B1 | | 4/2001 | Aschauer et al. | 441/80 |
| 6,270,386 B1 | | 8/2001 | Visocekas | 441/80 |
| 6,298,487 B1 | | 10/2001 | Mayhew | 2/108 |
| 6,412,482 B1 | | 7/2002 | Rowe | 128/204.18 |
| 6,433,691 B1 | * | 8/2002 | Hilliard et al. | 340/573.1 |
| 6,681,399 B1 | * | 1/2004 | Kerr | 2/2.5 |

FOREIGN PATENT DOCUMENTS

| | | | |
|---|---|---|---|
| DE | 195 16 872 A1 | | 11/1996 |
| DE | 19545864 A1 | * | 6/1997 |
| DE | 200 17 825 U 1 | | 11/2001 |
| GB | 1 479 733 | | 7/1977 |
| WO | WO 00/76589 A1 | | 12/2000 |
| WO | WO 01/08114 A2 | | 2/2001 |

* cited by examiner

*Primary Examiner*—Ajay Vasudeva
(74) *Attorney, Agent, or Firm*—Richard C. Litman

(57) ABSTRACT

A vest with air bag is a durable survival vest with shoulder pads and a front chest protector having ventilation holes therethrough and an attached air bag. The vest includes a shell defining a neck opening, a torso opening, and a pair of opposed arm holes. The vest also has a chest protector attached to the shell and an air bag attached to the chest protector. The air bag is configured to expand in front of a torso of a user. The vest includes a cartridge/canister, an activator, and a D-ring. The vest may include a power source, a sensor, a die marker, a cartridge/canister, an activator, a positioning device, a communication device, an antenna, control logic, and a communication bus. The D-ring is configured to operatively engage the activator to release breathable gas from the cartridge/canister when the D-ring is pulled by a user.

19 Claims, 5 Drawing Sheets

VEST WITH AIR BAG

CROSS REFERENCE TO RELATED APPLICATIONS

This application claims priority to U.S. Provisional Application Ser. No. 60/475,910, filed Jun. 5, 2003, which is incorporated herein by reference.

BACKGROUND OF THE INVENTION

1. Field of the Invention

The present invention relates to inflatable survival vests, and particularly to a vest with air bag that provides a protective safety measure for skiers in case of an avalanche.

2. Description of the Related Art

One of the most serious dangers faced by skiers and snow aficionados is the occurrence of an avalanche. This disaster often occurs with no warning and with such speed that anyone caught in its path has little or no time to avoid it. Victims of an avalanche are frequently buried under many feet of snow, causing them to suffocate before any rescue personnel are able to reach them. The deadly effects of an avalanche are well known, making the need for survival equipment abundantly clear.

Avalanche survival equipment has been developed to address this deadly problem. U.S. Pat. No. 6,220,909 B1, issued Apr. 24, 2001 to Peter Aschauer et al., describes an avalanche survival apparatus having an inflatable balloon attached to a frame to which the user is harnessed. A release mechanism deploys the balloon by filling it with a compressed gas. However, the Aschauer et al. '909 system is worn as a backpack and therefore creates a space in the snow behind the user, where it is not very helpful. A space in front of the user would be more advantageous, as it would provide an air pocket, protection for the user's face and room for the user to move his arms to dig out. The '909 system is also not equipped with side straps, which would allow a user to protect his/her arms while tumbling by holding the straps on the air bag. Finally, the Aschauer et al. '909 system appears to be somewhat bulky and therefore unsuitable for smaller users.

U.S. Pat. No. 6,270,386, issued Aug. 7, 2001 to Ariel R. Visocekas, describes an inflatable life jacket for use during an avalanche. The life jacket contains an air bag and a release system which inflates the air bag and can be activated automatically, or manually by pulling a release handle. Once the air bag is deployed, it encompasses the back and sides of the user's head, providing protection for that portion of the user. The air bag also serves as a buoyant force against the downward force of the avalanche and provides some breathable air. A hood or mesh is included to further shield the user from the elements. The Visocekas life jacket, however, does not deploy towards the front of the user, but rather only deploys along the sides and back of the head. Although the user's head and neck are protected, no space is created in front of the user which would allow the user to move his arms for the purpose of digging out.

U.S. Pat. No. 4,635,754, issued Jan. 13, 1987 to Peter Aschauer et al., describes an avalanche rescue apparatus in the form of a frame worn on the user's back and a balloon which deploys from the frame. The inflated balloon provides buoyancy during an avalanche thus keeping the user closer to the surface. Inflation of the balloon is achieved by pulling a ripcord which punctures two gas bottles and releases gas into the balloon. The Aschauer et al. '754 device, however, does not create space in the snow in front of the user and does not help the user keep his arms in position to dig out of the snow.

U.S. Pat. No. 4,365,628, issued Dec. 28, 1982 to Carl F. Hodel, describes an avalanche survival vest. The vest is designed to provide breathable air and added buoyancy during an avalanche. The Hodel vest, however, does not help the user to dig out of the snow. Rather, it only increases available rescue time.

World International Patent Organization (WIPO) Published Application No. WO 00/76589, published Dec. 21, 2000, describes a survival jacket having an inflatable chamber. Gas bottles containing air or oxygen are held in pockets on the jacket and are discharged when the user pulls on ripcords, which inflate the jacket. Gas permeable patches allow the gas to escape, providing breathable gas for the user. However, the WIPO '589 survival jacket does not provide a means of helping to keep the user's arms in position to dig out of the snow while also preventing injury to the arms.

Other related art includes U.S. Pat. No. 1,798,430, issued Mar. 31, 1931 to Peter Markus (inflatable safety device), U.S. Pat. No. 2,782,430, issued Feb. 26, 1957 to Matthew I. Radnofsky (flotation and thermal protecting apparel), U.S. Pat. No. 4,437,790, issued Mar. 20, 1984 to Timothy N. Trop (buoyancy compensator), U.S. Pat. No. 4,943,252, issued Jul. 24, 1990 (avalanche flotation ball), and WIPO Published Application No. WO 01/08114 A2, published Feb. 1, 2001 (avalanche safety vest).

None of the above inventions and patents, taken either singly or in combination, is seen to describe the instant invention as claimed. Thus a vest with air bag solving the aforementioned problems is desired.

SUMMARY OF THE INVENTION

The present invention is a vest with air bag. The vest includes a shell defining a neck opening, a torso opening, and a pair of opposed arm holes. The vest also has a chest protector attached to the shell and an air bag attached to the chest protector. The air bag is configured to expand in front of a torso of a user.

The vest includes a cartridge/canister, an activator, and a D-ring. The vest may include a power source, a sensor, a die marker, a cartridge/canister, an activator, a positioning device, a communication device, an antenna, control logic, and a communication bus. The D-ring is configured to operatively engage the activator to release breathable gas from the cartridge/canister into the air bag when the D-ring is pulled by a user.

The sensor is configured to compare a level of a monitored parameter with a reference signal and to effect automatic activation of the air bag when the monitored parameter level of the sensor equals or exceeds the reference signal to activate the activator to release breathable air from the cartridge/canister into the air bag. The sensor may be a temperature sensor, a water sensor, a contact sensor, a motion sensor, an infrared sensor, an acoustic sensor, an acceleration sensor, a hydrometer sensor, a sonic sensor, and/or a wind-speed sensor. The control logic may be firmware or may be configured as a microprocessor or a micro-controller.

The positioning device is configured to transmit a position signal regarding position data of the positioning device via a wireless communication link to determine the location of the positioning device or coordinate values of the positioning device relative to a predetermined reference point.

The communication device is configured to transmit and/or receive voice or data information via a wireless communication link. The communication device may be a cell phone, a personal digital assistant (PDA), a pager, a walkie talkie, a wireless Internet access device, a transponder, etc.

Accordingly, it is a principal aspect of the invention to provide a vest with air bag including a shell defining a neck opening, a torso opening, and a pair of opposed arm holes. The vest also has a chest protector attached to the shell and an air bag attached to the chest protector. The air bag is configured to expand in front of a torso of a user wearing the vest with air bag.

It is another aspect of the invention to provide a vest with air bag including a cartridge/canister, an activator, and a D-ring. The vest may include a power source, a sensor, a die marker, a cartridge/canister, an activator, a positioning device, a communication device, an antenna, control logic, and a communication bus. The D-ring is configured to operatively engage the activator to release breathable gas from the cartridge/canister when the D-ring is pulled by a user.

It is an aspect of the invention to provide improved elements and arrangements thereof in a vest with air bag for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
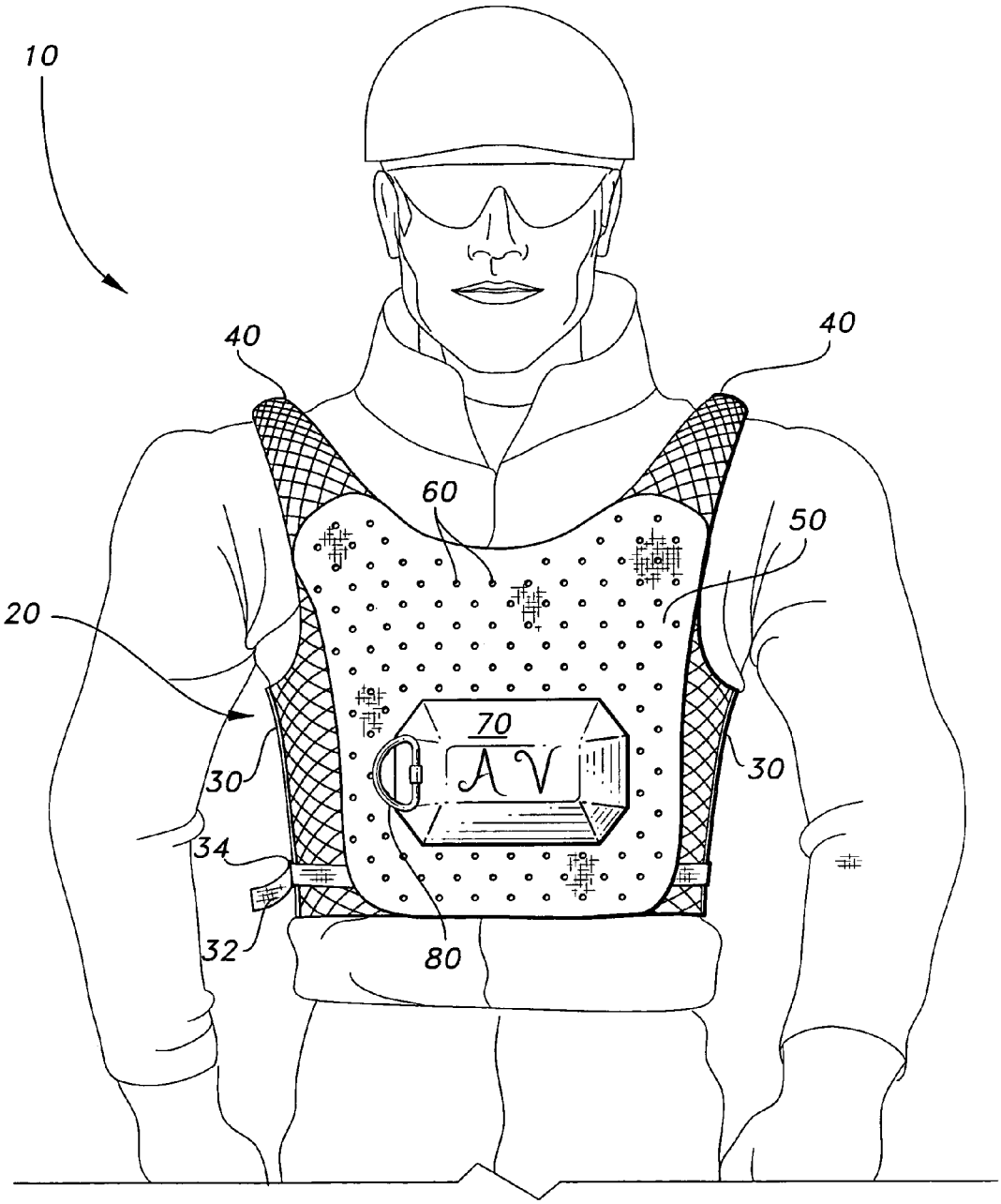
FIG. 1 is an environmental, front view of an avalanche survival vest with air bag according to the present invention.

The present invention is an avalanche survival vest with air bag. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

An avalanche survival vest with air bag is designated generally as 20 in the drawings. The avalanche survival vest 20 is designed to help an individual 10 survive an avalanche by creating a buoyant force, which keeps the wearer closer to the surface of the snow during an avalanche, and which forms an air pocket by displacing the snow in front of a wearer and releasing breathable air into that space.

Referring to the drawings, FIGS. 1-5 illustrate an avalanche survival vest with air bag 20 that includes side tensioning strips 30 on either side of the vest 20, for joining the front and rear portions of the vest 20. The tensioning strips 30 create a tight, but comfortable fit for the wearer. A strap 32 with fastener 34 is attached to the waist area of the vest 20, which further secures the vest 20 to the wearer. The vest 20 also includes shoulder pads 40, and a front chest protector 50 with ventilation holes 60.

An air bag housing 70 is fixedly mounted on the chest protector 50, and contains a deployable air bag 100. The air bag 100 may be manually deployed by pulling or manipulating a D-ring 80 disposed, as shown, on the right side of the air bag housing 70, from the wearer's perspective 10. The D-ring 80 may obviously be disposed on side other than the right side as desired (e.g, left side, top side, bottom side, etc.). The D-ring 80 operatively engages an activator (see FIG. 4) to release breathable gas into the air bag 100. Once deployed, the air bag 100 expands away from and to the front of the face and chest of the wearer 10.

Figure 2:
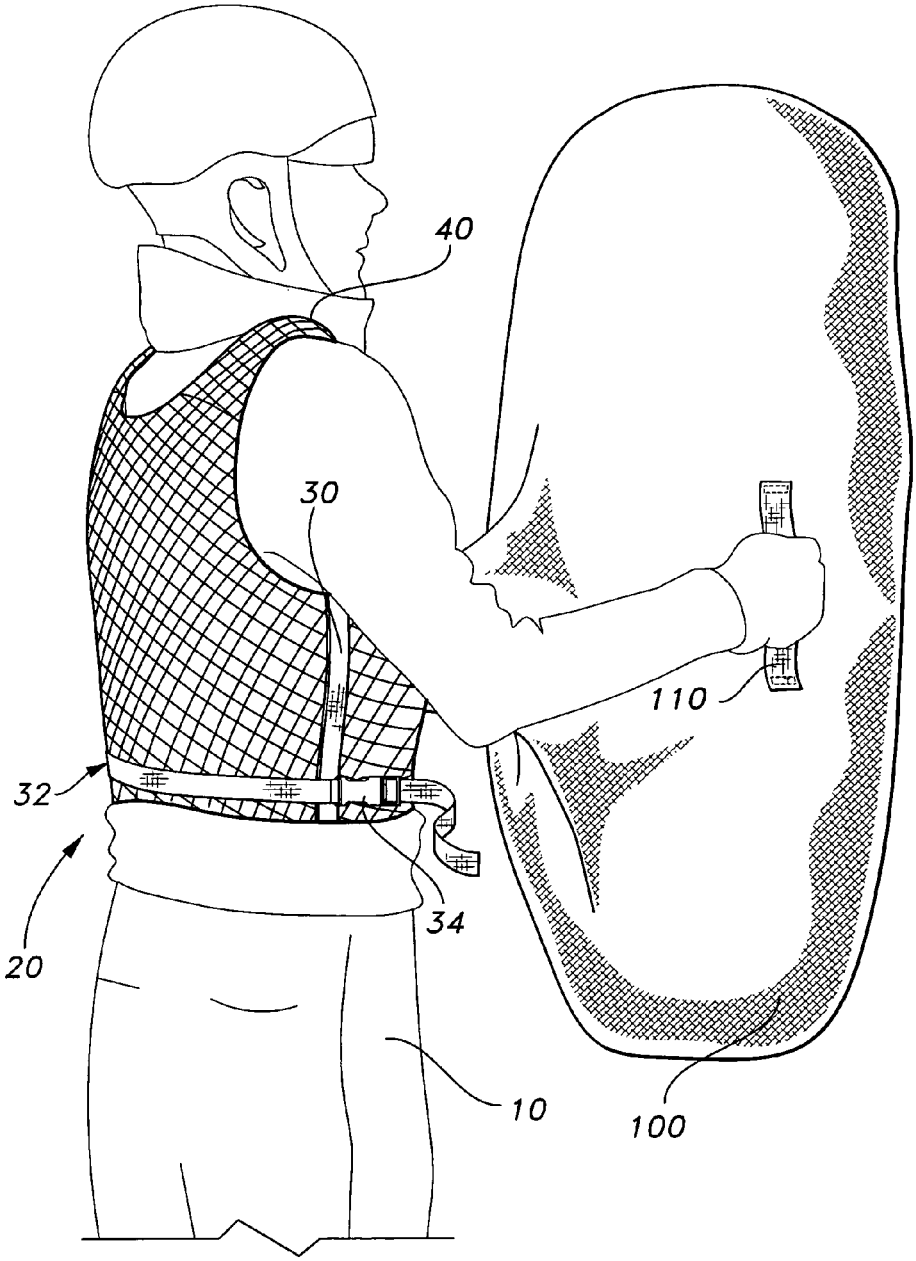
FIG. 2 is an environmental, side perspective view of an avalanche safety vest with air bag, showing the air bag in a deployed position.

FIG. 2 shows the air bag 100 in a deployed position. The deployed air bag 100 includes two strap handles 110, one on each side of the air bag 100, for the wearer 10 to grip after deployment. Gripping the strap handles 110 during an avalanche keeps the wearers arms in a more stable position by preventing them from flailing about. Gripping the strap handles 110 also helps to stabilize the air bag 100 and keeps the wearers arms in a position to dig out of the snow. After deployment, the air bag 100 gradually deflates, releasing breathable gas into the cavity in the snow formed by the air bag 100.

Figure 3:
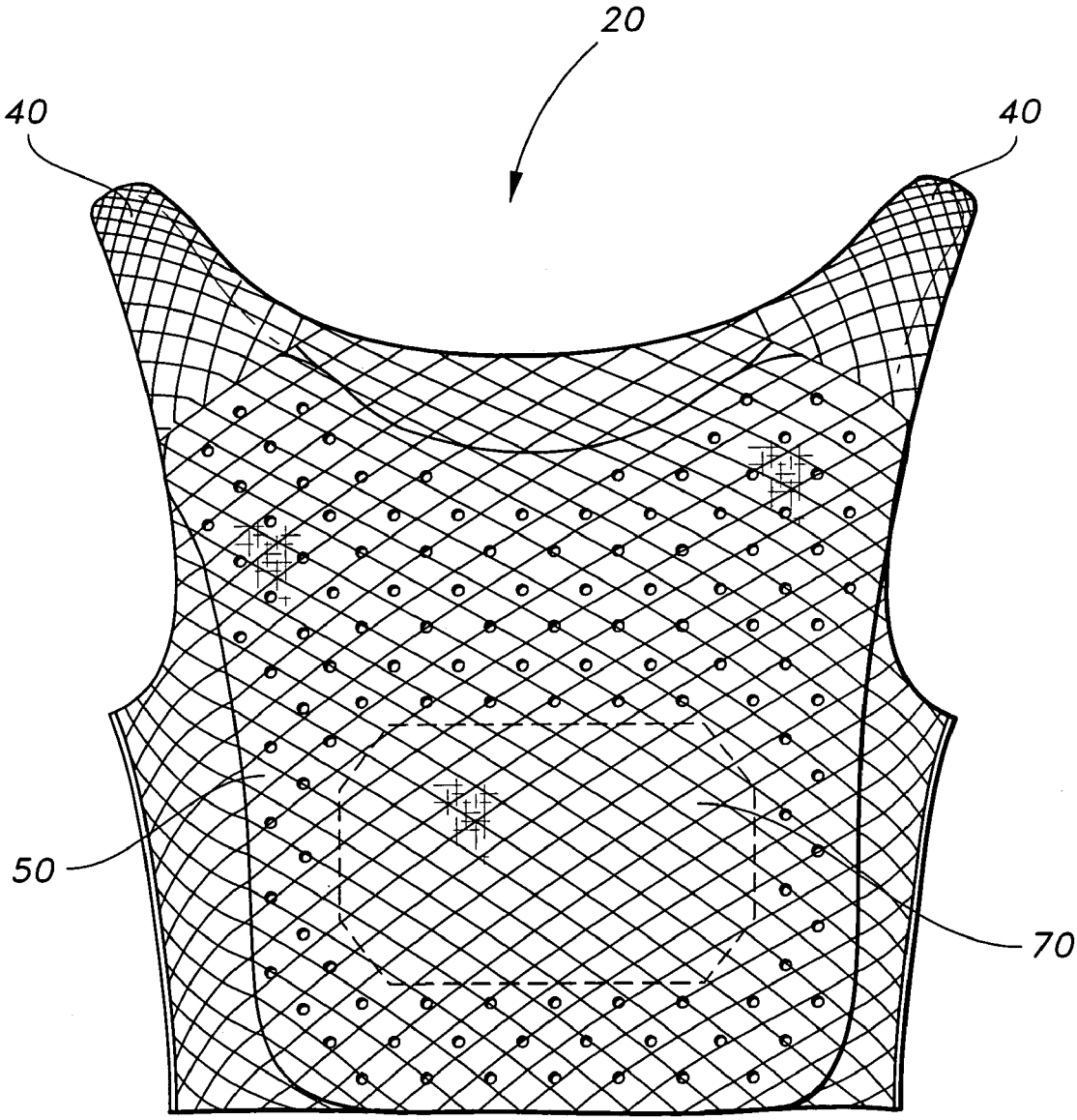
FIG. 3 is a rear view of the avalanche safety vest with air bag.

The vest 20 is made from a durable, flexible sheet of mesh material, such as but not limited to nylon, canvas, polyester or an equivalent material known to those knowledgeable in the art, which encompasses the user's torso and forms a support to which the chest protector 50 is attached. FIG. 3 shows a rear view of the avalanche survival vest with air bag 20 and illustrates how the durable mesh material 90 covers the back and shoulder areas.

Figure 4:
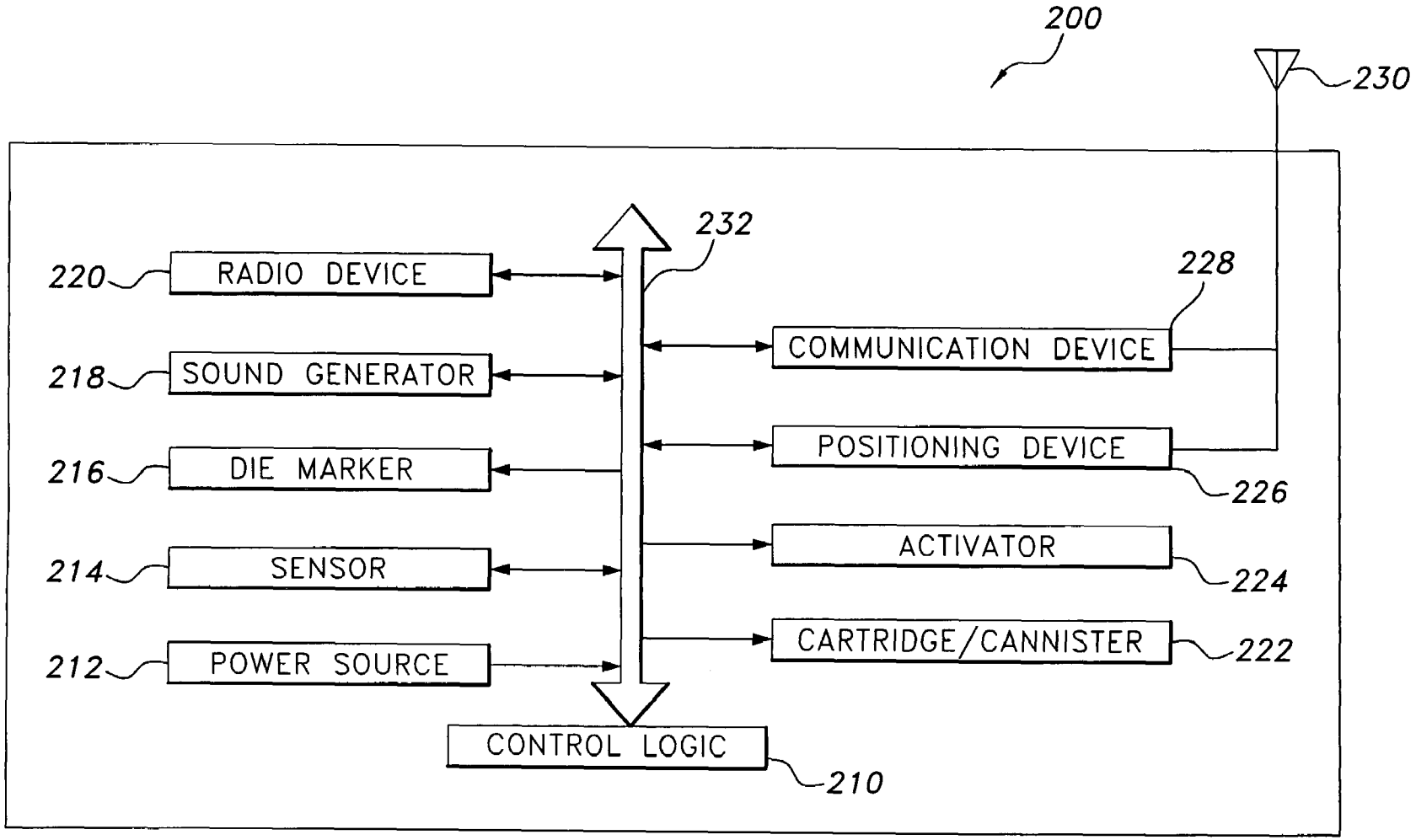
FIG. 4 is a block diagram of the avalanche safety vest with air bag.

FIG. 4 illustrates a block diagram 200 of features the vest with air bag 20 may include. Such features include control logic 210, a power source 212, a sensor 214, a die marker 216, a sound generator 218, a radio device 220, a cartridge/canister 222, an activator 224, a positioning device 226, a communication device 228, an antenna 230, a communication bus 232, etc.

The control logic 210 may be firmware or may be configured as a microprocessor, a micro-controller, etc. The power source 212 may be any desired power source, such as chargeable or non-rechargeable batteries, or the like. The sensor 214 may be any type of sensor for monitoring a particular parameter, such as acceleration, temperature, wind speed, water, etc. For example, sensor 214 may be a temperature sensor, a water sensor, a contact sensor, a motion sensor, an infrared sensor, an acoustic sensor, an acceleration sensor, a hydrometer sensor, a sonic sensor, a wind-speed sensor, or the like. The sensor 214 may be connected to conventional circuitry (not shown) that compares the level of the monitored parameter with a reference signal. When the monitored parameter level equals or exceeds the reference signal, the circuitry may output a signal, which may be either analog or digital in form, to activate the activator 220.

The die marker 216 is material that may be used by a user of the vest 20 to assist in his/her own rescue operation. In a similar manner, the vest 20 may include signal flares (not shown) to enable a user of the vest to assist in his/her own rescue operations.

The sound generator 218 includes sound generator circuitry configured to emit a synthetic sound, such as a siren, a bell, a buzzer, etc., at a predetermined decibel level. The radio device 220 includes radio receiver circuitry, a tuning display, and radio controls. The radio controls include controls for power, tuning, and volume. Optional radio controls may include station search, station seek, and stereo balance. The radio device 220 is configured to transmit and/or receive information and data, e.g., news, weather, alphanumeric or voice commands, or any data stream, over a predetermined frequency range, e.g., shortwave, VHF, UHF, etc.

The positioning device 226 may include any type of transmitter or transceiver configured to transmit a position signal or beacon regarding position data of the positioning device 226 via a wireless communication link having a predetermined maximum signal strength enabling signal reception by an appropriately configured receiving device. The positioning device 226 may also utilize any type or combination of terrestrial, satellite, cellular technology, and/or any components (e.g., digital or analog, the Global Positioning System (GPS), the Iridium system, cell phones, pagers, paging chips, etc.), and be configured to transmit and/or receive position data regarding the positioning device 226 via a wireless communication link and determine the location of the positioning device 226 or coordinate values of the positioning device 226 relative to a predetermined reference point. These elements may all be interconnected via any type of communication bus 230.

The communication device 228 includes communication circuitry and is configured to transmit and/or receive voice or data information via a wireless communication link. The communication device 228 may be a cell phone, a PDA, a pager, a walkie talkie, a wireless Internet access device, a transponder, etc. The communication device 228 may all be interconnected via any type of communication bus 230.

The air bag 100 is inflated by manual and/or automatic activation of the cartridge/canister 222, which releases pressurized, breathable gas into the air bag 100. The deployed air bag provides breathable air to a wearer who becomes buried under snow. The air bag 100 forms an air pocket by displacing the snow in front of the user, and then the slightly porous air bag 100 gradually deflates, releasing breathable gas into the air pocket. The air bag 100 also serves as a buoyant force during an avalanche, keeping the wearer closer to the surface of the avalanche.

Manual activation of the air bag 100 occurs when the D-ring 80 is pulled by a user and that operatively engages the activator 224 to release breathable gas from the cartridge/canister 222 into the air bag 100. Automatic activation of the air bag occurs when the monitored parameter level of the sensor 214 equals or exceeds a reference signal to activate the activator 224 to release breathable air from the cartridge/canister 222 into the air bag 100.

Figure 5:
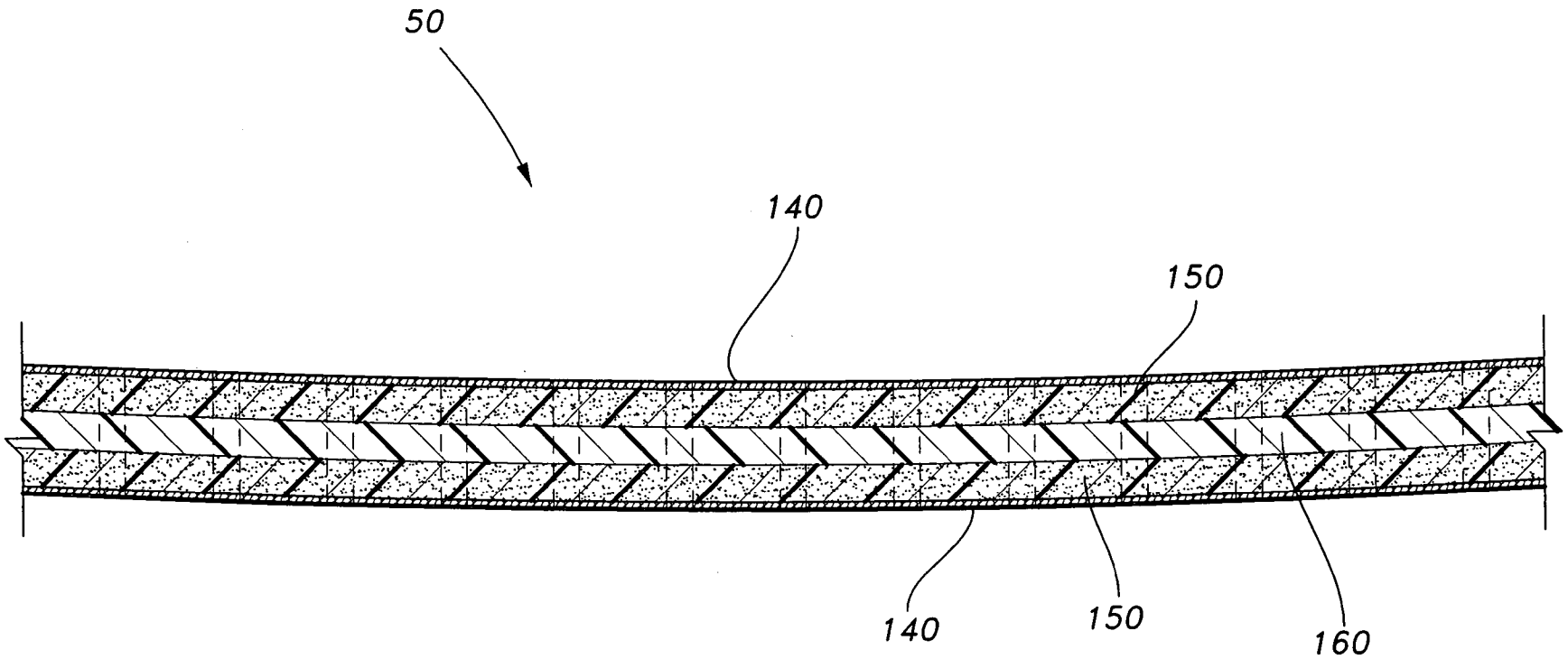
FIG. 5 is a fragmented sectional view of the chest protector of the avalanche safety vest with air bag showing the different layers of material comprising the chest protector portion of the safety vest.

FIG. 5 shows a cross-sectional view of the front chest protector. The outermost layer 140 of the chest protector 50 comprises a fabric covering, which may be any appropriate material, such as cotton, nylon, polyester, rayon, latex, spandex or a blend of these materials. The intermediate layer 150 comprises a foam material or equivalent that is approximately ⅛" thick. The foam layer 150 is disposed on either side of a central layer 160 of flexible plastic or equivalent material that is approximately ⅛" thick. These layers of material are bonded together through ordinary bonding processes to form a cohesive protective chest pad 50 with ventilation holes 60 distributed throughout.

As illustrated, the avalanche survival vest with air bag 20 is worn as a pullover vest. Alternatively, the vest 20 may be opened and closed on one side to allow the wearer to don the vest 20 by opening the vest 20 and then sliding his/her arms through the arm holes. According to such an example, the vest 20 would have closure element(s) in the front or in the back, such as fasteners, zippers, buttons, or snap hooks.

While the invention has been described with references to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A vest with air bag, comprising:

a shell defining a neck opening, a torso opening, and a pair of opposed arm holes;

a chest protector attached to said shell;

said vest including control logic and a communication bus;

an air bag attached to said chest protector; and a pair of handles located on opposite sides of said air bag;

whereby a user of said vest with air bag may grip said pair of handles when said air bag is expanded in front of a torso of a user.

2. The vest with air bag according to claim 1, further comprising a D-ring, a cartridge/canister, and an activator, said D-ring being configured to operatively engage the activator to release breathable gas from the cartridge/canister when the D-ring is pulled by a user.

3. The vest with air bag according to claim 1, further comprising a sensor, a cartridge/canister, and an activator, said sensor being configured to compare a level of a monitored parameter with a reference signal and to effect automatic activation of the air bag when the monitored parameter level of the sensor equals or exceeds the reference signal to activate the activator to release breathable air from the cartridge/canister into the air bag.

4. The vest with air bag according to claim 1, wherein said control logic is firmware.

5. The vest with air bag according to claim 1, wherein said control logic is a microprocessor or a micro-controller.

6. The vest with air bag according to claim 1, further comprising a power source.

7. The vest with air bag according to claim 1, further comprising a sensor configured to compare a level of a monitored parameter with a reference signal.

8. The vest with air bag according to claim 7, wherein said sensor is selected from the group consisting of a temperature sensor, a water sensor, a contact sensor, a motion sensor, an infrared sensor, an acoustic sensor, an acceleration sensor, a hydrometer sensor, a sonic sensor, and a wind-speed sensor.

9. The vest with air bag according to claim 1, further comprising a die marker.

10. The vest with air bag according to claim 1, further comprising a cartridge/canister.

11. The vest with air bag according to claim 1, further comprising an activator.

12. The vest with air bag according to claim 1, further comprising a positioning device and an antenna.

13. The vest with air bag according to claim 12, wherein said positioning device is configured to transmit/receive a position signal regarding position data of the positioning device via a wireless communication link and determine the location of the positioning device or coordinate values of the positioning device relative to a predetermined reference point.

14. The vest with air bag according to claim 13, wherein said positioning device includes a combination of terrestrial, satellite, and cellular technology components.

15. The vest with air bag according to claim 1, further comprising a communication device and an antenna.

16. The vest with air bag according to claim 15, wherein said communication device is configured to transmit/receive voice or data information via a wireless communication link.

17. The vest with air bag according to claim 16, wherein said communication device is a cell phone, a personal digital assistant (PDA), a pager, a walkie talkie, a wireless Internet access device, or a transponder.

18. The vest with air bag according to claim 1, further comprising a power source, a sensor, a die marker, a cartridge/canister, an activator, a positioning device, a communication device, an antenna.

19. The vest with air bag according to claim 1, wherein said vest is made of a durable, flexible sheet of mesh material.

* * * * *